US005083879A

United States Patent [19]

Sato et al.

[11] Patent Number: 5,083,879

[45] Date of Patent: Jan. 28, 1992

[54] IMAGE RECORDING APPARATUS

[75] Inventors: Tsuyoshi Sato, Tokyo; Mikihito Furuya; Tsutomu Mitsuishi, both of Yokohama; Hisaki Koyama, Chiba, all of Japan

[73] Assignee: Nikon Corporation, Tokyo, Japan

[21] Appl. No.: 693,096

[22] Filed: Apr. 30, 1991

Related U.S. Application Data

[63] Continuation of Ser. No. 363,922, Jun. 9, 1989, abandoned.

[30] Foreign Application Priority Data

Jun. 14, 1988 [JP] Japan ..... 63-146012

[51] Int. Cl.[5] ..... B41J 11/42

[52] U.S. Cl. ..... 400/579; 400/630; 271/250

[58] Field of Search ..... 400/579, 619, 630, 633, 400/633.1; 271/250, 251

[56] References Cited

U.S. PATENT DOCUMENTS

| | | | |
|---|---|---|---|
| 4,432,541 | 2/1984 | Clark et al. | 271/251 |
| 4,621,801 | 11/1986 | Scanchez | 400/633 |
| 4,685,664 | 8/1987 | Petersdorf | 271/250 |
| 4,805,892 | 2/1989 | Calhoun | 271/250 |

OTHER PUBLICATIONS

IBM Technical Disclosure Bulletin vol. 24, No. 2, Jul. 1981.

IBM Technical Disclosure Bulletin vol. 27, No. 9, Feb. 1985.

*Primary Examiner*—David A. Wiecking
*Assistant Examiner*—Ren Yan
*Attorney, Agent, or Firm*—Shapiro and Shapiro

[57] ABSTRACT

In an image recording apparatus in which a pinch roller restrains lateral movement of image receiving paper, a skew feed roller and an edge guide are operative, by virtue of a curved portion of the paper feed path between the pinch roller and the skew roller, to position the paper laterally despite the restraint imposed by the pinch roller. The skew roller and the edge guide are disposed along a straight portion of the paper feed path.

1 Claim, 3 Drawing Sheets

IMAGE RECORDING APPARATUS

This is a continuation of application Ser. No. 363,922 filed June 9, 1989, now abandoned.

BACKGROUND OF THE INVENTION

1. Field of the Invention

The present invention relates to an image recording apparatus, and more particularly, it relates to a heat transfer colored image recording apparatus.

2. Related Background Art

In general, a thermal recording apparatus of heat transfer type is so designed that an ink sheet and an image receiving paper (transfer paper) are overlapped and heat or thermal pulses are applied to the ink sheet by means of a thermal head. Since the ink which can be liquidized or sublimated by the heat is coated on the ink sheet, the ink on the ink sheet where the thermal pulses are applied is transferred to the image receiving paper, thus recording image information corresponding to the thermal pulses on the image receiving paper. Because the thermal head is of the line printing type, in order to record the image or images on the whole area of the image receiving paper, it is necessary to shift the thermal head and the image receiving paper relatively.

Conventionally, in many cases, the thermal head is fixedly mounted so a not to be shifted and the image receiving paper is shifted with respect to the thermal head. The following techniques are typical of the prior art: a drum fixing technique wherein one end of the image receiving paper is fixed to a drum by means of a pawl and the like and the thermal head is pressed against the image receiving paper with the interposition of the ink sheet and the drum is rotated to shift or rotate the image receiving paper together with the ink sheet, thereby printing the image on the image receiving paper; a pinch roller technique wherein the image receiving paper is pinched between the drum and a pinch roller and the thermal head is pressed against the image receiving pape,r thereby printing the image on the image receiving paper; or a capstan roller technique wherein the image receiving paper is pinched between the thermal head and a small rubber roller and the image receiving paper is shifted or fed by means of a separate capstan rollers.

However, each of the above-mentioned techniques has both merit and demerit with respect to the size and/or cost of the recording apparatus and with respect to chromatic shear in printing, and, thus, conventionally, one of these techniques has been selected in accordance with the purpose of the image recording apparatus to be used.

Recently, a new technique called a "one-way circulating feed system" has been proposed, independently of the above-mentioned techniques, which could eliminate the demerits of the above-mentioned three techniques.

Explaining this new system with reference to FIG. 5, a thermal head 1 is pressed against a platen (main roller) 2 with the interposition of an ink sheet 4 and an image receiving paper 5. The ink sheet 4 is coated by paint. An auxiliary roller 3 serves to circulate the image receiving paper 5. The ink sheet 4 is fed from a feed roll 31 to a take up roll 30 through guide rollers 7 and 8. The image receiving paper 5 is introduced from a paper inlet 6. Pinch rollers 16–19 serve to press the image receiving sheet 5 against the platen 2 and auxiliary roller 3. The image receiving paper 5 is guided by guides 10–15. An optical sensor 9 detects a leading edge of the image receiving paper 5 to determine the timing of initiation of printing or recording.

In operation, when the image receiving paper 5 is introduced from the paper inlet 6, the platen 2 and auxiliary roller 3 start to rotate, with the result that the image receiving paper 5 is passed between the guides 11 and 12 and then is wound around the platen 2. When the leading edge of the image receiving paper 5 reaches the optical sensor 9, a signal is emitted to start the printing. The image receiving paper 5 being printed is then passed between the guides 14 and 15 and is wound around the auxiliary roller 3. Subsequently, the same image receiving paper 5 is guided by the guides 11, 12 again to reach the platen 2. When the printing or recording with a first color is completed, the leading edge of the image receiving paper 5 is positioned near the thermal head 1. Further, when the leading edge of the image receiving paper reaches the optical sensor 9 again, the printing with a second color is initiated. In this way, the printing operations with the second, third and fourth colors are repeated to finally obtain a colored image.

Although such an arrangement is meritorious in that the whole apparatus can be small-sized and the leading edge of the image receiving paper can be positioned near the thermal head immediately after each printing operation is completed, there arises a drawback in that chromatic shear in printing occurs when an image with each of the third and fourth colors is overlapped on the previously formed image. Such chromatic shear in printing occurs as follows: even when the image receiving paper is properly wound on the platen, i.e., even when the leading edge of the image receiving paper is parallel to an axis of rotation of the platen 2, if the leading edge of the image receiving paper when wound on the auxiliary roller 3 is not substantially parallel to an axis of rotation of the auxiliary roller, the image receiving paper will deviate from a paper feeding direction transversely. Such deviation is caused by the fact that the platen and/or auxiliary roller is not completely cylindrical and that the axis of rotation of the platen is not completely parallel to the axis of rotation of the auxiliary roller. As a result, shear in printing occurs due to such deviation of the image receiving paper, which leads to deterioration of image quality.

SUMMARY OF THE INVENTION

An object of the present invention is to provide an image recording apparatus of one-way circulating feed type, which can eliminate the above conventional drawback and can reduce chromatic shear in printing.

In order to achieve the above object, according to the present invention, a skew-feed roller and a side guide for guiding a transverse edge of an image receiving paper are arranged in a straight portion of a paper feeding path, and the paper feeding path is curved between a pinch roller and the skew-feed roller and side guide.

DESCRIPTION OF THE PREFERRED EMBODIMENT

The present invention will now be explained with reference to the accompanying drawings.

Figure 2:
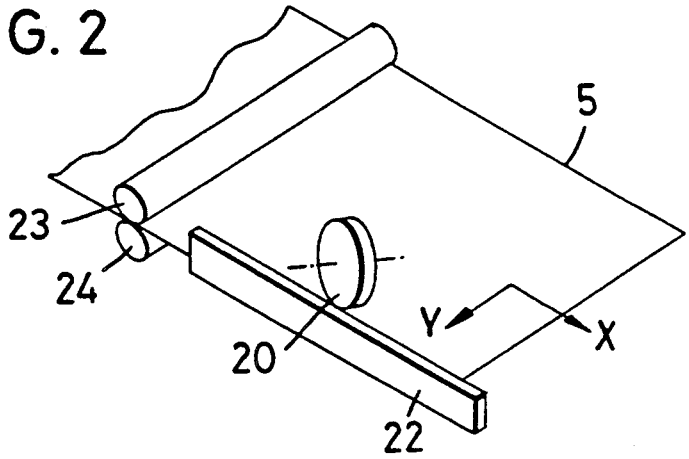
Figure 3:
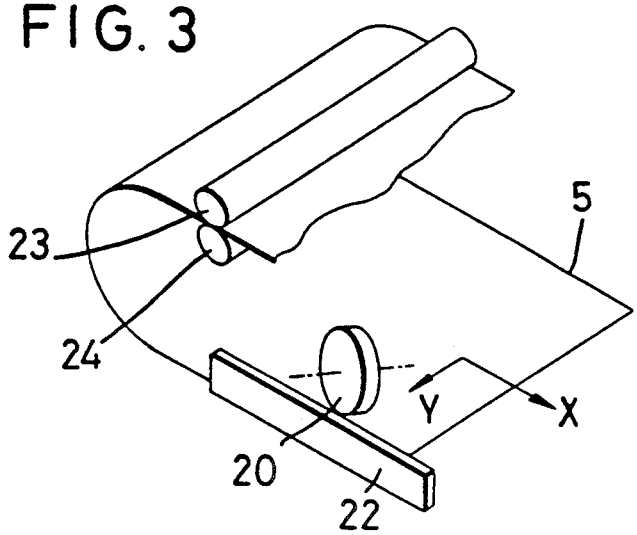

First of all, the principle of the present invention will be explained in connection with FIGS. 1 to 3.

Figure 1:
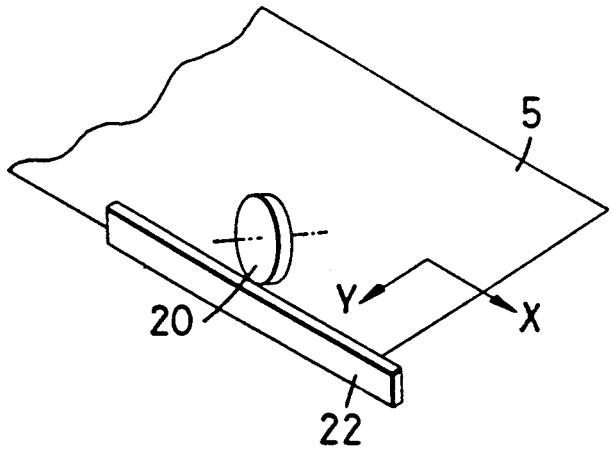
FIGS. 1 to 3 are perspective views of a paper feeding path, showing a principle of the present invention.

In FIG. 1, a skew-feed roller 20 and a side guide plate 22 for guiding a transverse edge of an image receiving paper (transfer paper) 5 are arranged in a straight portion of a paper feeding path in order to position the image receiving paper in a Y-direction (direction perpendicular to a paper feeding direction X). The paper feeding operation by the use of such elements 20, 22 functions properly when the image receiving paper is freely fed without restriction of movement thereof due to other elements; however, as shown in FIG. 2, when the image receiving paper 5 is restrained, for example, by pinch rollers 23 and 24, it is normally difficult to position the image receiving paper in the Y-direction. However, as shown in FIG. 3, if the same image receiving paper is used and is restrained by the pinch rollers, when the paper feeding path situated between the skew-feed roller and the pinch rollers is curved, the resistance to movement of the image receiving paper in the Y-direction will be decreased considerably to permit the positioning of the image receiving paper in the Y-direction.

Figure 4A:
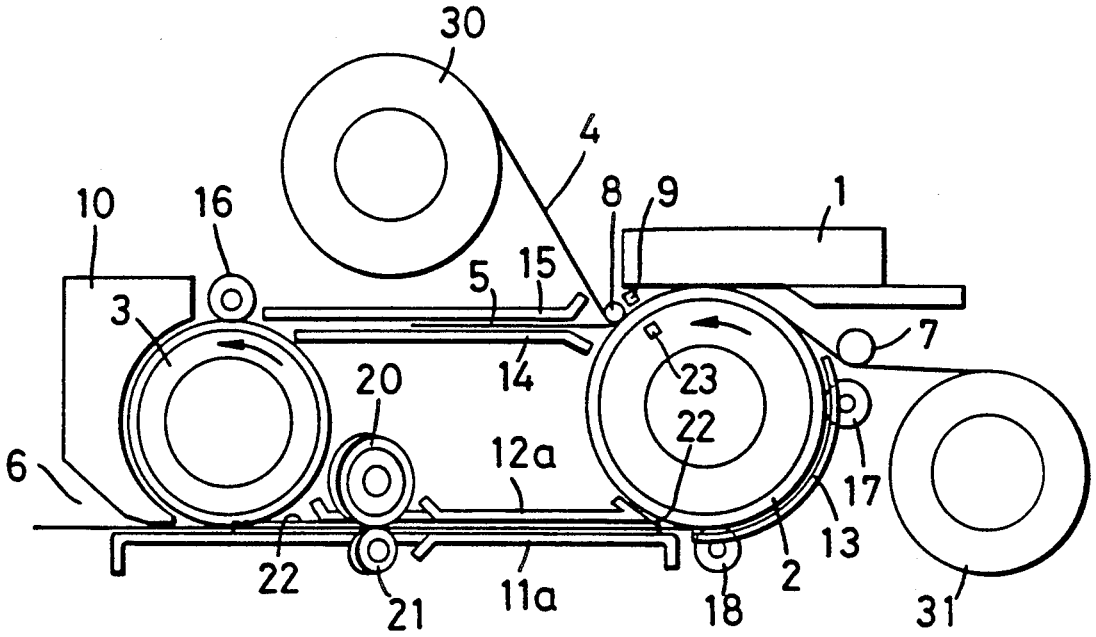
FIG. 4A is a side view of an image recording apparatus according to an embodiment of the present invention.
Figure 4B:
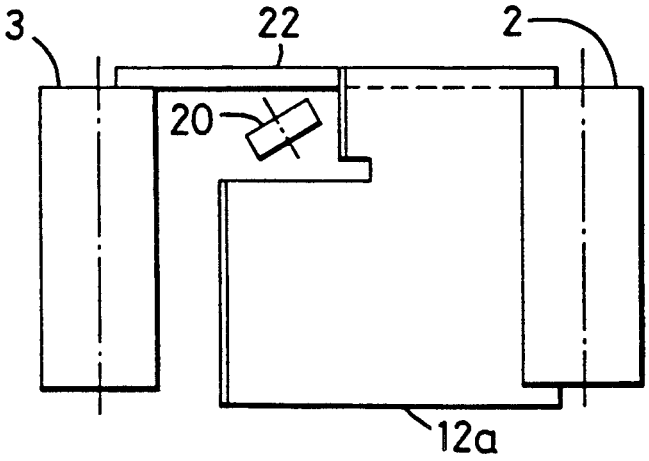
FIG. 4B is a plan view showing a portion of the apparatus of FIG. 4A.

FIGS. 4A and 4B show a construction of an image recording apparatus according to a preferred embodiment of the present invention.

Figure 5:
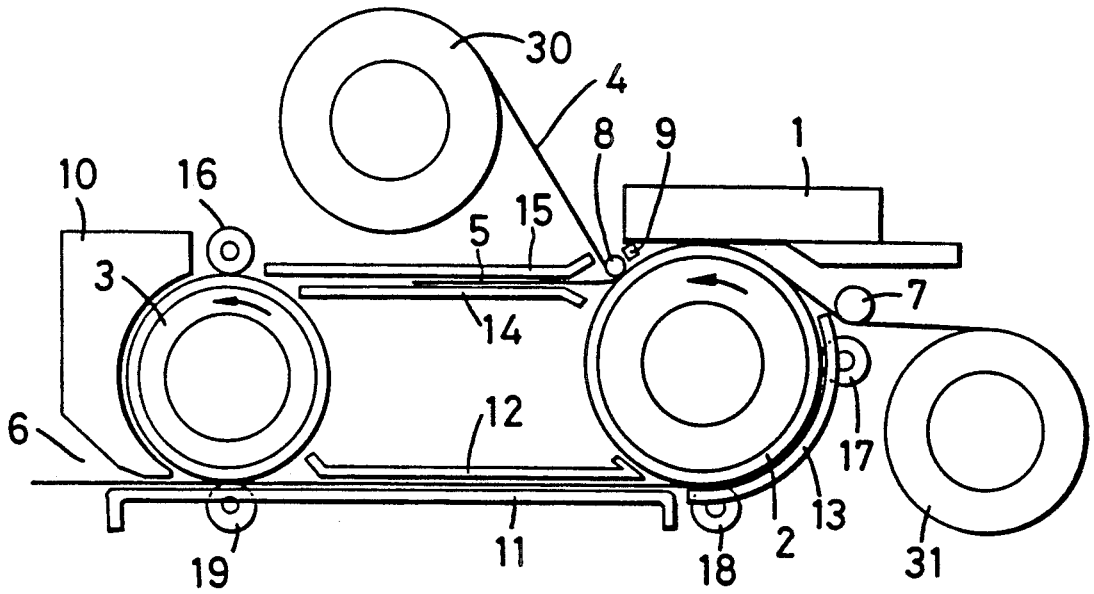
FIG. 5 PRIOR ART
FIG. 5 is a side view of a conventional image recording apparatus.

The image recording apparatus shown in FIG. 4A (present invention) differs from the conventional apparatus shown in FIG. 5 in that the apparatus of FIG. 4A does not have the pinch roller 19 (FIG. 5) and is provided with a skew-feed roller 20, a pinch roller 21 and a side positioning guide plate 22 and that shapes of guide plate 11*a*, 12*a* differ from those of the guides 11, 12 of FIG. 5. FIG. 4B shows a positional relation between the skew-feed roller 20, positioning guide plate 22, guide plate 12*a*, platen 2 and auxiliary roller 3.

Next, an operation of the image recording apparatus a constructed above will be explained.

When the image receiving paper 5 is introduced into a paper inlet 6, an optical sensor (not shown) emits a signal to rotate the platen 2, auxiliary roller 3 and skew-feed roller 20. When the image receiving paper 5 is further pushed forwardly, the leading edge of the image receiving paper is pinched between the skew-feed roller 20 and the pinch roller 21 thereby to feed the paper toward the platen 2. At the same time, the image receiving paper 5 is urged against a vertical wall of the side positioning guide plate 22, thus positioning the image receiving paper in a transverse direction thereof. Thereafter, the leading edge of the image receiving paper 5 reaches the platen 2, and then the image receiving paper is pinched between the platen and pinch rollers 17, 18 to move with the platen. Angular velocity of the platen 2 is selected to be slightly higher than that of the skew-feed roller 20. However, since a one-way clutch (not shown) is arranged on a shaft of the skew-feed roller 20, the image receiving paper is moved at a speed corresponding to the angular velocity of the platen 2. When the leading edge of the image receiving paper 5 reaches an optical sensor 9, the latter emits a signal by which electric power is supplied to a thermal head 1, whereby predetermined image information is printed or recorded on the image receiving paper with a yellow color, for example. Incidentally, the optical sensor 9 emits a signal when light from a photoelectric element 23 (to the optical sensor 9) is blocked by the image receiving paper 5. The width of an ink sheet 4 is so selected that the ink sheet is narrower than the width of the image receiving paper 5 so as not to block the light from the photoelectric element 23 to the optical sensor 9. During the recording operation by means of the thermal head, the leading edge of the image receiving paper 5 passes between guides 14 and 15 and then is wound around the auxiliary roller 3. Since angular velocity of the auxiliary roller 3 is selected to be slightly lower than the angular velocity of the platen 2, a forward tension tending to pull the image receiving paper is not applied to the image receiving paper. When the printing operation goes on further, the leading edge of the image receiving paper reaches the skew-feed roller 20 again, where the image receiving paper is positioned again in the transverse direction thereof. Although transverse movement of the image receiving paper 5 is restrained by the pinch roller 16, since the paper sheet path is so designed that the image receiving paper 5 is curved between the pinch roller 16 and the skew-feed roller 20, resistance to transverse movement of the image receiving paper 5 is decreased, whereby the image receiving paper can easily be positioned in the transverse direction thereof. Since the angular velocity of the skew-feed roller 20 is selected to be slightly lower than that of the auxiliary roller 3, the image receiving paper 5 is not tightly pressed against the surface of the auxiliary roller 3, so that the image receiving paper can be freely changed in shape between a guide 10 and the auxiliary roller 3. When the printing operation goes on further, the leading edge of the image receiving paper 5 is wound around the platen 2. Since a one-way clutch (not shown) is arranged on a shaft of the auxiliary roller 3, the image receiving paper 5 can be moved at a speed corresponding to the angular velocity of the platen 2. When a predetermined number of lines is printed and the printing operation with the yellow color is completed, the leading edge of the image receiving paper 5 on the platen 2 reaches the vicinity of the thermal head 1. Then, when the optical sensor 9 detects the leading edge of the image receiving paper 5, a new printing operation with a magenta color, for example, is started. Similarly to the above, the printing operation with the magenta color is repeated, and lastly, a printing operation with a cyan color, for example, is similarly repeated, thus completing the whole printing cycle.

As mentioned above, according to the present invention, since the image receiving paper can be properly positioned in the transverse direction thereof even if transverse movement of the image receiving paper is restrained, chromatic shear in printing (deviation in positions between the overlapped colored images) can be effectively reduced or eliminated.

We claim:

1. An image recording apparatus for printing an image on image receiving paper, having a paper feeding path for circulating the image receiving paper in one direction, comprising:

(a) restraining means that operates to restrain said image receiving paper from movement in a direction transverse to a longitudinal direction of said paper feeding path, said restraining means including first and second roller means arranged to pinch said image receiving paper therebetween;

(b) positioning means that operates concurrently with said restraining means to position said image receiving paper in a direction transverse to the longitudinal direction of said paper feeding path and to provide a predetermined relation between said image receiving paper and said paper feeding path, said positioning means including third roller means disposed at a straight portion of said paper feeding path and rotatable about an axis skewed with respect to said straight portion for shifting said image receiving paper in a direction transverse to the longitudinal direction of said paper feeding path, and a side edge restriction member for engaging a side edge of said image receiving paper and thereby limiting transverse movement of said image receiving paper caused by said third roller means, said positioning means being spaced from said restraining means downstream in the paper feeding direction;

(c) means for curving said paper feeding path between said restraining means and said positioning means and for reducing resistance to transverse movement of said image receiving paper so as to permit said third roller means to shift said image receiving paper transversely despite the restraint imposed on said image receiving paper by said restraining means;

(d) fourth roller means for circulating said image receiving paper in said paper feeding path;

(e) head means for printing an image on said image receiving paper, said head means being arranged in confronting relation to said fourth roller means; and (f) a pair of guide plates disposed adjacent to opposite surfaces of said image receiving paper along said straight portion of said paper feeding path between said third roller means and said fourth roller means;

wherein angular velocity of one of said first and second roller means is higher than angular velocity of said third roller means, and angular velocity of said fourth roller means is higher than said angular velocity of said one of said first and second roller means.

* * * * *